US011795749B2

(12) United States Patent
Xue et al.

(10) Patent No.: US 11,795,749 B2
(45) Date of Patent: Oct. 24, 2023

(54) DAMPING HINGE

(71) Applicant: Fuzhou Autran Industrial Co., Ltd., Fujian (CN)

(72) Inventors: Liang Xue, Fujian (CN); Fan Chen, Fujian (CN)

(73) Assignee: FUZHOU AUTRAN INDUSTRIAL CO., LTD., Fuzhou (CN)

( * ) Notice: Subject to any disclaimer, the term of this patent is extended or adjusted under 35 U.S.C. 154(b) by 100 days.

(21) Appl. No.: 17/535,683

(22) Filed: Nov. 25, 2021

(65) Prior Publication Data

US 2022/0081948 A1 Mar. 17, 2022

Related U.S. Application Data

(63) Continuation of application No. PCT/CN2020/092044, filed on May 25, 2020.

(30) Foreign Application Priority Data

Jul. 29, 2019 (CN) ..... 201910687791.2

(51) Int. Cl.

| | |
|---|---|
| ***E05D 5/02*** | (2006.01) |
| ***E05F 3/20*** | (2006.01) |
| ***E05D 11/00*** | (2006.01) |
| ***E05F 3/04*** | (2006.01) |
| *E05D 3/02* | (2006.01) |

(52) U.S. Cl.

CPC ..... *E05F 3/20* (2013.01); *E05D 11/00* (2013.01); *E05F 3/04* (2013.01); *E05D 3/02* (2013.01); *E05Y 2900/132* (2013.01); *E05Y 2900/148* (2013.01)

(58) Field of Classification Search

CPC ..... E05D 3/02; E05D 5/0246; E05D 5/0253; E05D 5/0261; E05D 5/0269; E05D 11/00;

(Continued)

(56) References Cited

U.S. PATENT DOCUMENTS 8,561,765 B2 * 10/2013 Chen ..... E05F 5/10 188/271
8,863,356 B2 * 10/2014 Bacchetti ..... F16F 9/18 16/54

(Continued)

FOREIGN PATENT DOCUMENTS

CN 202299829 U * 7/2012
CN 206487279 U 9/2017

(Continued)

OTHER PUBLICATIONS

International Search Report of PCT Patent Application No. PCT/CN2020/092044 dated Aug. 17, 2020.

*Primary Examiner* — Chuck Y Mah
(74) *Attorney, Agent, or Firm* — McCoy Russell LLP

(57) ABSTRACT

This invention discloses a damping hinge that includes a first clamp plate and a second clamp plate, wherein one or more damping mechanisms are arranged on the first clamp plate and/or the second clamp plate. The damping mechanism includes a fixed pressure block, a movable pressure block which is able to move in the vertical direction, and a damper which is arranged vertically and has two ends connected to the fixed pressure block and the movable pressure block respectively. A first inclined surface of the movable pressure block is in abutting connection with a second inclined surface on the other clamp plate. This invention drived the damper to compress and retract vertically and improved the damping effect and service life of the damper.

20 Claims, 6 Drawing Sheets

(58) Field of Classification Search
CPC ..... E05D 2003/027; E05D 2005/0253; E05D 2005/0269; E05D 2005/0263; E05D 2005/0261; E05D 2201/21; E05D 2201/264; E05D 2201/41; E05D 2201/46; E05D 2201/492; E05D 7/081; E05D 7/08; E05Y 2900/132; E05Y 2900/148; E05Y 2900/114; E05Y 2600/502; E05Y 2600/60; E05F 1/1215; E05F 1/12; E05F 1/1207; E05F 3/04; E05F 3/20; E05F 3/18; E05F 11/385; E06B 3/54; A47K 3/362; A47K 2003/367; A47F 3/12; A47F 3/125; Y10T 16/534; Y10T 16/5383; Y10T 16/53828; Y10T 16/53845
See application file for complete search history.

(56) References Cited

U.S. PATENT DOCUMENTS

| | | | | |
|---|---|---|---|---|
| 9,874,049 | B1 * | 1/2018 | McGregor | E05D 5/065 |
| 9,879,462 | B2 * | 1/2018 | Svara | E05F 5/006 |
| 10,041,685 | B2 * | 8/2018 | Kim | F24C 15/023 |
| 10,280,671 | B2 * | 5/2019 | Kirenci | E05F 5/02 |
| 10,718,146 | B2 * | 7/2020 | Svara | F16F 9/19 |
| 10,934,757 | B2 * | 3/2021 | Svara | E05F 5/02 |
| 2016/0060932 | A1 * | 3/2016 | Stuart | E05F 5/02 16/297 |
| 2016/0076292 | A1 * | 3/2016 | Stuart | E05F 1/1215 16/297 |
| 2016/0153224 | A1 * | 6/2016 | Salice | E05D 3/16 16/65 |
| 2017/0114581 | A1 * | 4/2017 | Jeanrot | E05F 3/20 |
| 2019/0048634 | A1 * | 2/2019 | Sevastopoulos | E05D 7/086 |
| 2019/0211602 | A1 * | 7/2019 | Stuart | E05F 3/20 |
| 2020/0300016 | A1 * | 9/2020 | Allen | E05F 5/10 |
| 2022/0235594 | A1 * | 7/2022 | Laws | E05F 5/02 |

FOREIGN PATENT DOCUMENTS

| | | | | |
|---|---|---|---|---|
| CN | 108756552 | A * | 11/2018 | E05D 11/00 |
| CN | 105793508 | B * | 4/2019 | E05D 11/0054 |
| GB | 2469847 | A * | 11/2010 | E05F 5/006 |
| KR | 20030022625 | A * | 3/2003 | |
| KR | 20090031116 | A * | 3/2009 | |

* cited by examiner

DAMPING HINGE

CROSS REFERENCE TO RELATED APPLICATIONS

The present application is a Continuation Application of PCT Application No. PCT/CN2020/092044 filed on May 25, 2020, which claims the benefit of Chinese Patent Application No. 201910687791.2 filed on Jul. 29, 2019. All the above are hereby incorporated by reference in their entirety.

TECHNICAL FIELD

The invention relates to the field of hinges, specifically to a kind of damping hinge.

BACKGROUND

Hinges are devices or parts capable of connecting two portions of a machine, vehicle, door, window, or implement, wherein one or both portions connected through the hinge can rotate around the axis of the hinge. Hinges are generally applied to doors, windows, cupboards, and the like.

Most existing hinges for doors and windows are back-flap hinges without dampers. Doors and windows without dampers may generate loud noises and violent vibrations, which affect user experience. In view of this, damping hinges are designed with dampers to make sure that doors and windows can move slowly when closing and return slowly when released by hand due to control from the dampers. Damping hinges generate less noises and fewer vibrations compared with hinges without dampers.

Applying pressure to the pressure rod from an angle exceeding 3° should be avoided when the damper is working on the pressure rod. However, due to the fact that the dampers of existing hinges are arranged horizontally, the surface abutting the pressure rods will rotate continuously along with the rotation of the two clamp plates of the hinge. The pressure angle of the pressure rods will change in real time which means that they cannot remain below 3° at all times and has an effect on the damping effect and service life of the damper.

SUMMARY OF THE INVENTION

It is an object of the invention to provide a damping hinge with an improved damping effect and/or with an improved service life of the damper.

The technical solution adopted by the invention to address the above-mentioned technical issue object is as follows:

In one aspect, the invention provides a damping hinge that includes a first clamp plate and a second clamp plate, wherein one or more damping mechanisms is/are arranged in the first clamp plate and/or the second clamp plate. The damping mechanism includes a fixed pressure block, a movable pressure block that moves in a vertical direction, and a damper which is arranged vertically and has two ends connected to the fixed pressure block and the movable pressure block, respectively. A first inclined surface of the movable pressure block is in abutting connection with a second inclined surface on the other clamp plate.

The invention has the following beneficial effects: In the damping hinge, one or more damping mechanisms are arranged in the first clamp plate and/or the second clamp plate. The two ends of the damper are respectively connected to the fixed pressure block and the movable pressure block; the movable pressure block moves in a vertical direction which applies vertical acting force on the damper, thereby improving the damping effect and service life of the damper. The horizontal movement of the first and second clamp plates in the damping hinge means that the first inclined surface of the movable pressure block is in abutting connection with the second inclined surface on the other clamp plate. When the moveable pressure block and the fixed pressure block are rotating horizontally, the interacting force between the first and second inclined surfaces means that the movable pressure block and the fixed pressure block can also achieve vertical motion, which thereby drives the dampers to expand and contract vertically.

DESCRIPTION OF DRAWING LABELS

Figure 1:
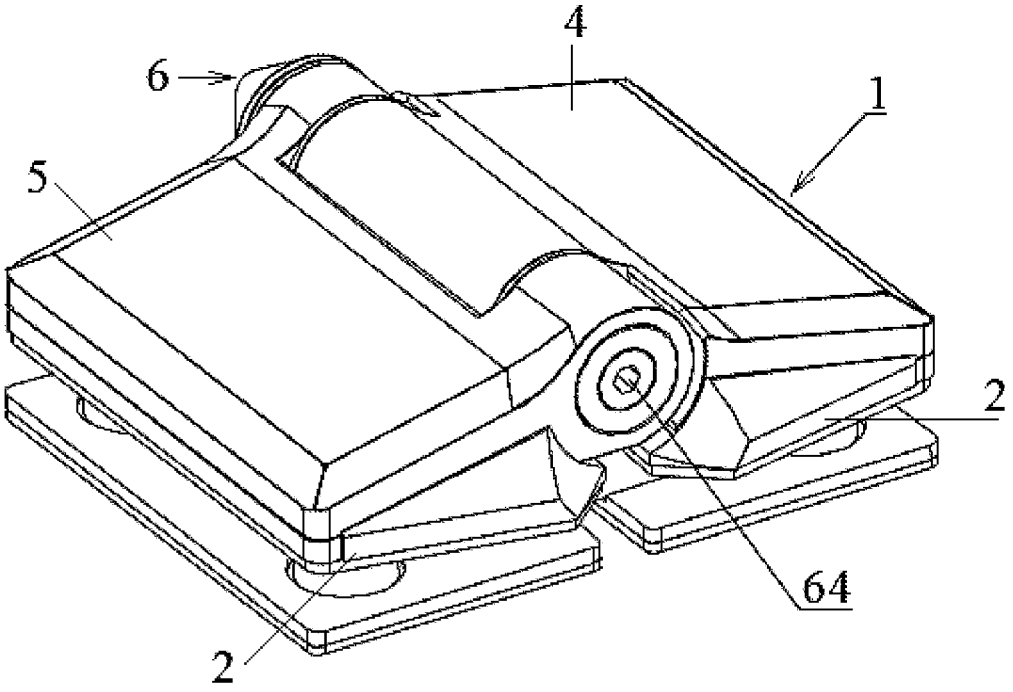
FIG. 1 is an overall view of a damping hinge in an embodiment of the invention.

1, hinge body; 2, damper base; 3, damping mechanism; 4, first clamp plate; 5, second clamp plate; 6, rotation shaft; 21, damper groove; 22, slide notch; 31, fixed pressure block; 32, movable pressure block; 33, damper; 34, first inclined surface; 35, second inclined surface; 35', extension or extending portion; 36, pressure rod; 37, holding slot; 38, slide groove; 39, slide rod; 61, rotation pin; 62, automatic tension adjuster; 63, torsion spring; 64, adjustment slot; 65, adjustment block; 66, spring; 67, rotation block; 68, pawl base.

EMBODIMENTS OF THE INVENTION

Description of Embodiments of the Invention

In order to give a detailed description of the technical content of this invention, the purposes and effects of the invention are explained below in combination with the embodiments and accompanying drawings.

Referring to FIG. 1 to FIG. 8, a damping hinge comprises a first clamp plate and a second clamp plate, wherein one or more damping mechanisms are arranged in the first clamp plate and/or the second clamp plate. The damping mechanism includes a fixed pressure block, a movable pressure block which is able to move in a vertical direction, and a damper which is arranged vertically and has two ends connected to the fixed pressure block and the movable pressure block respectively. A first inclined surface on the movable pressure block is in abutting connection with a second inclined surface on the other clamp plate.

Therein, three cases apply to where one or more damping mechanisms are arranged in the first clamp plate and/or the second clamp plate: One damping mechanism is arranged in the first clamp plate; or, one damping mechanism is arranged in the second clamp plate; or, damping mechanisms are arranged in both the first and second clamp plates. Therefore, a first inclined surface on the movable pressure block in abutting connection with a second inclined surface on the other clamp plate can be understood as follows: The first inclined surface on the movable pressure block in the first clamp plate is in abutting connection with the second inclined surface on the second clamp plate; or, the first inclined surface of the movable pressure block in the second clamp plate is in abutting connection with the second inclined surface of the first clamp plate; or, the first inclined surface of the movable pressure block on the first clamp plate is in abutting connection with the second inclined surface of the fixed pressure block on the second clamp plate and the first inclined surface of the movable pressure block on the second clamp plate assembly is in abutting connection with the second inclined surface of the fixed pressure block on the first clamp plate assembly. Moreover, abutting connection can be understood as follows: The first inclined surface abuts against the second inclined surface from above; or the second inclined surface abuts against the first inclined surface from above.

According to the above description, the invention has the following beneficial effects: One or more damping mechanisms are arranged in the first clamp plate and/or the second clamp plate; the two ends of each damper are vertically connected to the fixed pressure block and the movable pressure block respectively; the movable pressure block moves in a vertical direction which applies vertical acting force on the damper, thereby improving damping effect and service life of the damper. When the moveable pressure block and the fixed pressure block are rotating horizontally, the interacting force between the first and second inclined surfaces means that the movable pressure block and the fixed pressure block can also achieve vertical motion, which thereby drives the dampers to contract and expand vertically.

Furthermore, the first inclined surface and the second inclined surface are spiral inclined surfaces attached to each other, with the spiral angle of the spiral inclined surfaces being [5°, 85° ]. The spiral diameters of the spiral inclined surfaces are equal to the rotational diameters of the positions where the spiral inclined surfaces are located.

It should be noted that spiral inclined surfaces attached to each other refers to an upper inclined surface and a lower inclined surface cut along the same spiral tangent, wherein one inclined surface serves as the first inclined surface and the other inclined surface serves as the second inclined surface.

From the above description, when the first clamp plate and the second clamp plate rotate, the first spiral inclined surface and the second spiral inclined surface are pressed upon each other to make the movable pressure block continuously compress the damper. That is to say that the inclined surfaces rotate horizontally and move vertically at the same time, on the whole. The spiral inclined surfaces are simulated according to the movement paths of the inclined surfaces to cause the first inclined surface and the second inclined surface to always be in surface contact when pressed against each other. Compared with line-to-line or point-to-point contact, the stress is more uniform, the squeezing effect is more ideal, and damage to the two inclined surfaces is avoided, thereby guaranteeing the damping effect and service life of the damper.

Furthermore, the total length of the first inclined surface and the second inclined surface is either greater or less than the maximum rotation distance between the first clamp plate and the second clamp plate.

From the above description, when the first and second clamp plates are opened to the maximum extent, the first inclined surface is still in surface contact with the second inclined surface, so that the first clamp plate and the second clamp plate are damped when they start to close, thereby guaranteeing a better damping effect. At the same time, compared to solutions where squeezing contact only occurs during the rotation process, there is no process where rotational force is stored until it reaches a certain level at which point only then does contact occur. This makes the whole closing process of the damping hinge much smoother and avoids damage to the two inclined surfaces brought about by sudden stress.

Furthermore, the damper is a hydraulic damper which includes a vertical pressure rod.

From the above description, the hydraulic damper is used for damping, so that the damper has a good damping effect, makes less noise, is low in cost, convenient to install, highly practical, and easy to promote and use.

Furthermore, the damping hinge also includes a damper base, in which a damper groove is formed and in which the damping mechanism is arranged.

From the above description, the damper groove has a fixing and limiting function as well as a protecting effect. In addition, with regard to the technical solution in which the entire damping mechanism is arranged in the damper groove, setting the length of the damper groove to be smaller than that of the damping mechanism when the damper is not compressed ensures that the damping mechanism will not extend completely after being placed in the damping groove. This means that the damping mechanism will apply a counter-force to the movable pressure block and the fixed pressure block to abut against both sides of the damper groove, thereby forming a clamping effect to a certain extent and giving an auxiliary fixing function. This will guarantee stability of the damping mechanism in the damper groove.

Furthermore, a holding slot matched with the hydraulic damper is formed in the fixed pressure block of the damping hinge. A slide groove is formed along on the side of the fixed pressure block that is close to the moveable pressure block and a slide rod extends from the side of the moveable pressure block that is close to the fixed pressure block. The slide rod and slide groove connect vertically along the slide groove.

From the above description, one side of the hydraulic damper is stationary mounted in the holding slot which has a dual effect of fixing and limiting as well as protecting. The slide groove in the fixed pressure block is matched with the slide rod on the movable pressure block. The slide rod connects to the slide groove vertically, so that the movable pressure block acts in a vertical direction on the pressure rod of the hydraulic damper. Moreover, the limiting from the holding slot and the guidance from the slide groove holding slot means that the pressure rod of the damper is always compressed in a vertical direction, thereby improving the damping effect and service life of the damper.

Furthermore, the damping mechanisms are arranged both in the first clamp plate and in the second clamp plate. The pressure rod on the first clamp plate is vertically connected to the movable pressure block; the pressure rod on the second clamp plate is vertically connected to the bottom of the holding slot. The first inclined surface of the movable pressure block on the first clamp plate is in abutting connection with the second inclined surface of the fixed pressure block on the second clamp plate.

It should be noted that, in the same way, the pressure rod on the second clamp plate is vertically connected to the movable pressure block and the pressure rod on the first clamp plate assembly is vertically connected to the bottom of the holding slot.

Existing damping hinges generally adopt horizontal hydraulic dampers. Although the hydraulic dampers are sealed, daily use may cause hydraulic fluid to slightly overflow from openings due to compression and gravity acting on the horizontal hydraulic dampers, thus resulting in fluid leakage.

From the above description, the damping mechanisms on the first clamp plate and the second clamp plate are rotationally symmetrical, so that the first inclined surfaces and the second inclined surfaces can work together as they exert pressure on one another. That is to say that when the movable pressure block of the clamp plate on one side is located above, the fixed pressure block of the clamp plate on the other side is also located above. On this basis, the pressure rods of the two clamp plate assemblies are kept in the same direction when connected to different pressure blocks and the pressure rods on both sides are kept upright. The openings of the hydraulic dampers are formed in the same sides as the corresponding pressure rods. That is to say that the hydraulic dampers in this application open upwards. Moreover, the hydraulic dampers are compressed vertically, so that hydraulic fluid leakage is effectively avoided, which improves the damping effect and service life of the dampers.

Furthermore, the damping mechanism is arranged in the first clamp plate. The second inclined surface is arranged on an extending portion of the second clamp plate assembly, close to the first inclined surface. The fixed pressure block has a limit portion matched with the hydraulic damper and the damper groove is formed with a slide notch for holding both sides of the movable pressure block all the times.

From the above description, the damper mechanism is arranged on only one clamp plate and the second inclined surface matched with the first inclined surface is arranged on the other clamp plate. In this case, the movable pressure block is always held in the slide notch in order to limit the motion of the movable pressure block as it moves vertically, thereby achieving both limiting and guiding effects.

Furthermore, the movable pressure block includes two symmetrical first inclined surfaces. The two second inclined surfaces are connected to the first inclined surfaces from their arrangement on the extension portion of the second clamp plate assembly.

From the above description, although the damping mechanism is arranged on only one clamp plate, the first clamp plate assembly and the second clamp plate assembly can rotate in two directions through the configuration of the symmetrical inclined surfaces.

Furthermore, the damper base is detachably connected to the damping mechanism.

From the above description, the detachable connection means that the damping mechanism is easy to detach, maintain, and replace, thereby improving user experience of the damping hinge.

Referring to FIG. 1 to FIG. 6, Embodiment 1 of the invention is as follows:

A damping hinge in this embodiment is suitable for connecting two portions of a machine, a vehicle, a door, a window, or other implements, and is also suitable for the rotation of glass doors.

The damping hinge is composed of a hinge body 1 which includes a first clamp plate 4, a second clamp plate 5, damping mechanisms 3 respectively arranged in the first clamp plate 4 and the second clamp plate 5, and damper bases 2 corresponding to the damping mechanisms 3, wherein damper grooves 21 are formed in the damper bases 2, the damping mechanisms 3 are arranged in the damper grooves 21, and the length of the damper grooves 21 is set to be smaller than that of the damping mechanisms 3 when dampers 33 are not compressed, so that the damping mechanisms 3 will not extend completely after being placed in the damper grooves 21 and will apply a counter-thrust to movable pressure blocks and fixed pressure blocks to abut against two sides of the damper grooves 21 in order to achieve a clamping effect to a certain extent for auxiliary fixing, thereby guaranteeing the stability of the damping mechanisms 3 in the damper grooves 21.

In this embodiment, the dampers 33 are hydraulic dampers, and each hydraulic damper includes an upright pressure rod 36.

Figure 5:
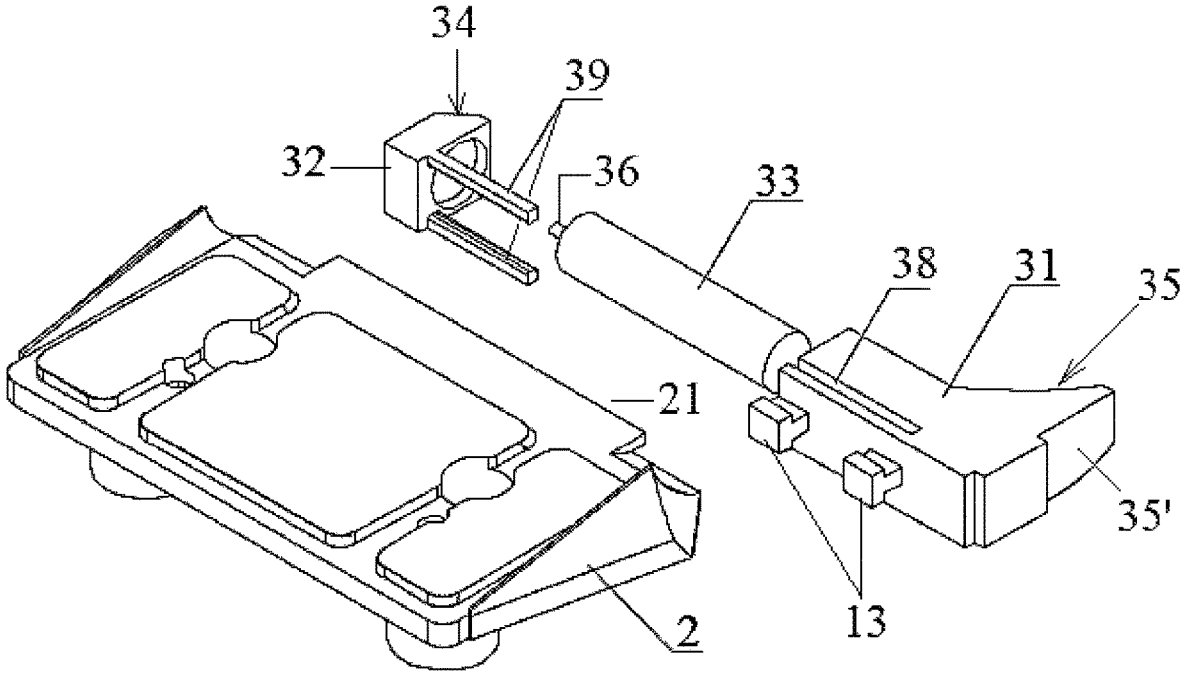
FIG. 5 is a cooperation diagram of a damper base and a damping mechanism in an embodiment of the invention.
Figure 6:
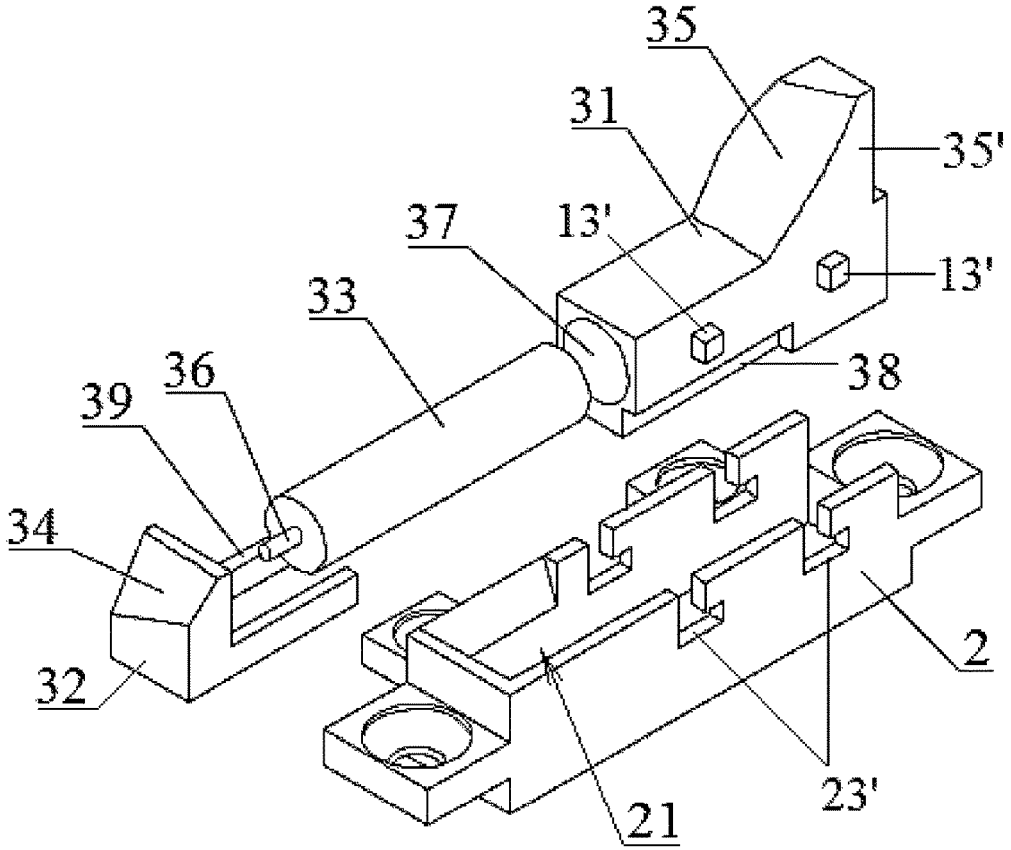
FIG. 6 is another cooperation diagram of the damper base and the damping mechanism in an embodiment of the invention.

As shown in FIG. 5 and FIG. 6, each damping mechanism 3 includes one fixed pressure block 31, one movable pressure block 32, and one damper 33, wherein two ends of the damper 33 are vertically connected to the fixed pressure block 31 and the movable pressure block 32 respectively. The movable pressure block 32 moves in a vertical direction to apply a vertically directed force to the damper 33 which is arranged vertically. A first inclined surface 34 of the movable pressure block 32 is in abutting connection with a second inclined surface 35 of the fixed pressure block 31 of the other clamp plate, so that the movable pressure block 32 and the corresponding fixed pressure block 31 can move vertically to drive the damper 33 to retract and extend vertically.

As shown in FIG. 5 and FIG. 6, the first inclined surface 34 of the movable pressure block 32 on the first clamp plate 4 is in abutting connection with the second inclined surface 35 of the fixed pressure block 31 on the second clamp plate 5. The first inclined surface 34 of the movable pressure block 32 on the second clamp plate assembly 5 is in abutting connection with the second inclined surface 35 of the fixed pressure block 31 on the first clamp plate 4 and the second inclined surface 35 abuts against the first inclined surface 34 from above. In other embodiments, the first inclined surfaces 34 may abut against the second inclined surfaces 35 from above.

As shown in FIG. 5 and FIG. 6, the first inclined surface 34 and the second inclined surface 35 are spiral inclined surfaces The spiral angle of the spiral inclined surfaces is [5°, 85° ], and the spiral diameters of the spiral inclined surfaces are equal to the rotation diameters of positions where the spiral inclined surfaces are located. That is to say that the spiral inclined surfaces are simulated according to the movement paths of the inclined surfaces to make sure that the first inclined surface 34 and the second inclined surface 35 are always in surface contact when they press against one another. This makes for better compression effect and avoids damage to either of the two inclined surfaces, thereby ensuring the damping effect and service life of the damper 33.

As shown in FIG. 5 and FIG. 6, the total length of the first inclined surface 34 and the second inclined surface 35 is either greater or less than the maximum rotation distance between the first clamp plate 4 and the second clamp plate 5. In this embodiment, the first inclined surface 34 of the movable pressure block 32 is relatively short. The length of the whole movable pressure block 32 corresponds to the upper half of the fixed pressure block 31. The second inclined surface 35 extends on an extension or extending portion 35' from the lower half of the fixed pressure block 31 and is relatively long. In other embodiments, the length of the first inclined surface 34 and the length of the second inclined surface 35 can be set as one wishes, but the total length of the first inclined surface 34 and the second inclined surface 35 should be either greater or less than the maximum rotation distance between the first clamp plate 4 and the second clamp plate 5 to ensure that the first inclined surface 34 is still in surface contact with the second inclined surface 35 when the first clamp plate 4 and the second clamp plate 5 are opened to the maximum extent. In another embodiment, the first inclined surface 34 and the second inclined surface 35 only engage in surface contact during rotational movement between the first clamp plate 4 and the second clamp plate 5. That is to say that the rotational movement between the first clamp plate 4 and the second clamp plate 5 is divided into two stages: the first stage is when the rotation of the hinge is allowed to accelerate where the first inclined surface 34 and the second inclined surface 35 have not come into surface contact; the second stage is when the first inclined surface 34 and the second inclined surface 35 come into surface contact to achieve a damping effect. In this embodiment, the total length of the first inclined surface 34 and the second inclined surface 35 is either less than or equal to the maximum rotation distance between the first clamp plate 4 and the second clamp plate 5.

Figure 2:
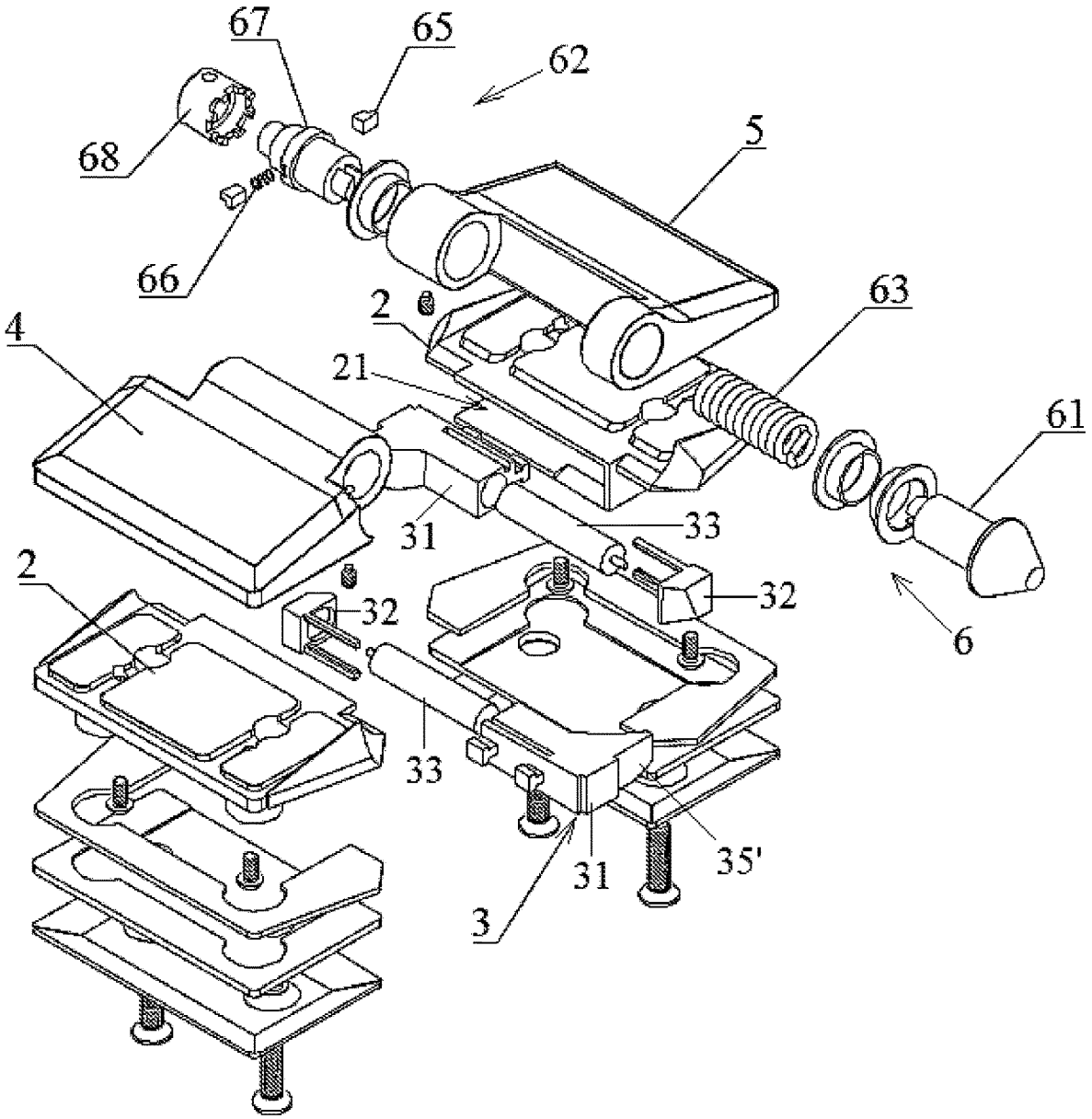
FIG. 2 is a disassembled view of the damping hinge in an embodiment of the invention.
Figure 3:
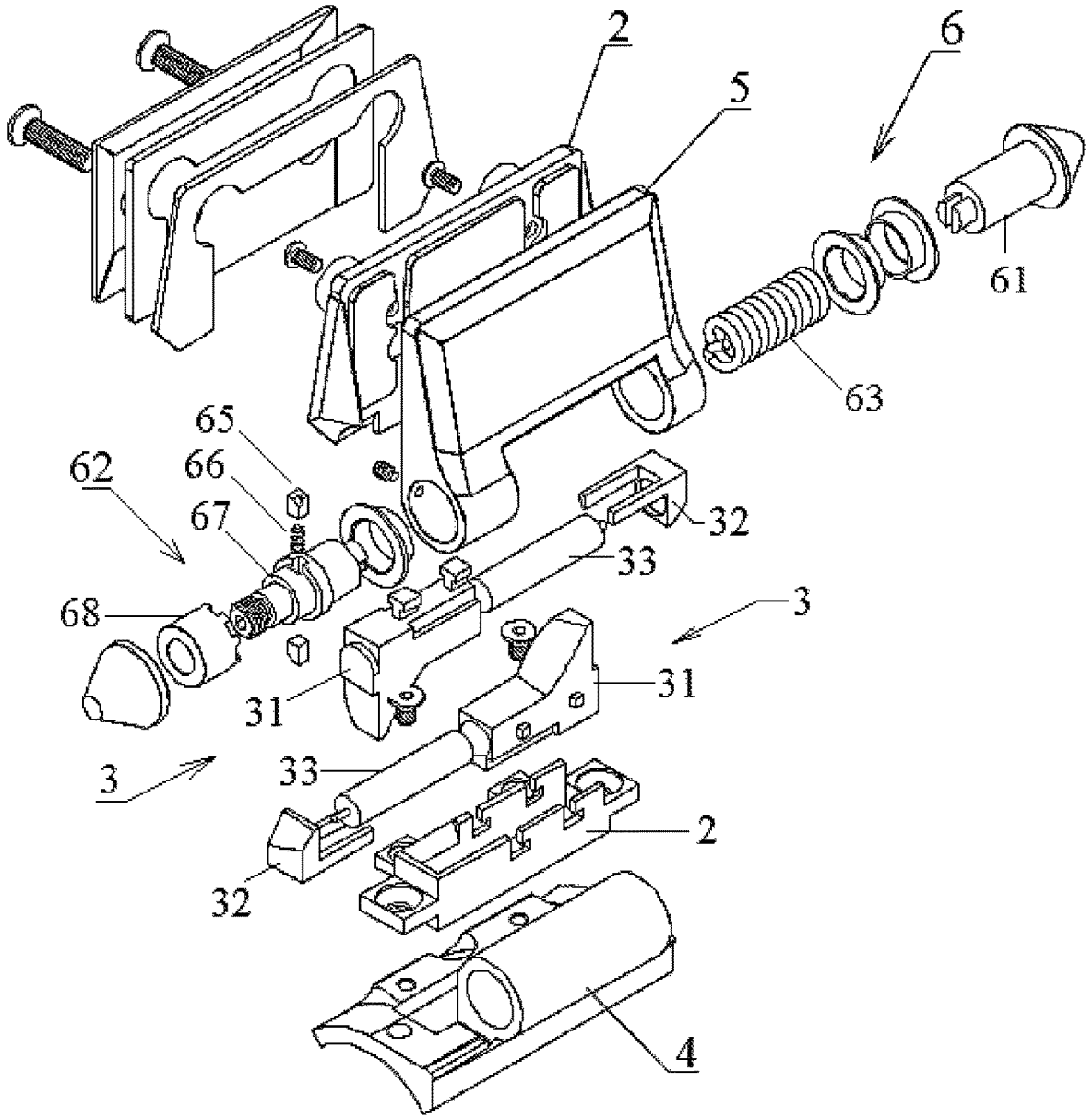
FIG. 3 is a disassembled view of a damping hinge in another embodiment of the invention.
Figure 4:
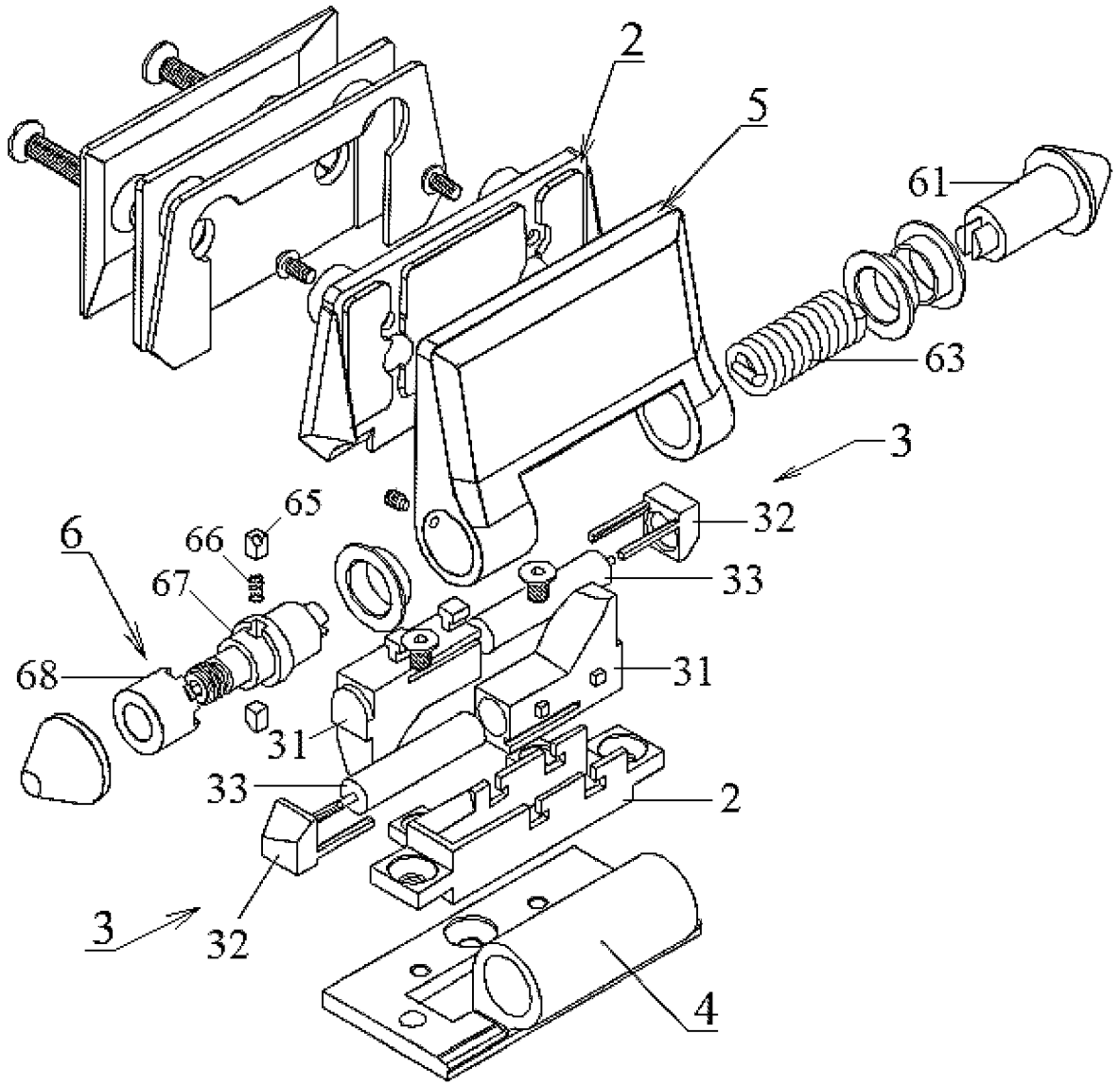
FIG. 4 is a disassembled view of the damping hinge in another embodiment of the invention.

As shown in FIG. 2 to FIG. 4, the second clamp plates 5 are identical in structure and the first clamp plates 4 are different in structure. This includes the two-way rotation in FIG. 2, and in FIG. 3 which has one clamp plate axially mounted while the other clamp plate is able to rotate, as well as FIG. 4, which has flat surface mounting and single leaf rotation. It can be seen that in this embodiment, the second clamp plate 5 and the first clamp plate 4 rotate relative to one another. That is to say that one or both of the first clamp plate 4 and the second clamp plate 5 are able to rotate. Furthermore, the specific shape and structure of the second clamp plate 5 as well as the specific shape and structure of the first clamp plate 4 are not limited to those shown in the diagrams.

At the same time, as shown in FIG. 2 to FIG. 4, the damping mechanisms 3 in both clamp plates are identical in structure but installed in a rotationally symmetrical way. Under such circumstances, only one set of tooling is required for manufacturing one set of damping mechanisms 3, which is advantageous for assembly and production as well as subsequent maintenance and replacement. In addition, arranging the damping mechanisms 3 symmetrically on both sides ensures that hinge closing force applies better compression to the damper 33.

Referring to FIG. 1 to FIG. 6, Embodiment 2 of the invention is as follows:

The damping hinge in this embodiment is suitable for connecting two portions of a machine, a vehicle, a door, a window, or other implements, and is also suitable for the rotation of glass doors.

Based on Embodiment 1, as shown in FIG. 5 and FIG. 6, a holding slot 37 matched with the hydraulic damper is formed in the fixed pressure block 31 of the damping hinge, slide grooves 38 are formed in the side of the fixed pressure block 31 close to the movable pressure block 32. Slide rods 39 stretch out of the side of the movable pressure block 32 close to the fixed pressure block 31 and slide vertically to connect with the slide grooves 38. In this way, the movable pressure block 32 is limited by the holding slot 37 and guided by the slide grooves 38 to move vertically.

As shown in FIG. 5 and FIG. 6, the slide grooves 38 are lateral notches and the slide rods 39 are square-shaped rods. In other embodiments, the slide grooves 38 can also be slide holes and the slide rods 39 can be cylindrical rods; or, the slide grooves 38 can be slide rails and the slide rods 39 can be slide blocks or other sliders for making the movable pressure blocks 32 slide in a certain direction.

In this embodiment, the pressure rods 36 on the left and right sides are connected to the movable pressure blocks 32. In other optional embodiments, the pressure rods 36 on the left and right sides are connected to the fixed pressure blocks 31.

Referring to FIG. 1, Embodiment 3 of the invention is as follows:

The damping hinge in this embodiment is suitable for connecting two portions of a machine, a vehicle, a door, a window, or other implements, and is also suitable for the rotation of glass doors.

Based on Embodiment 2, the connection of the pressure rods 36 and the pressure blocks of the damping hinge in this embodiment is limited and substituted as follows: The pressure rod 36 on the first clamp plate assembly 4 is vertically connected to the movable pressure block 32, and the pressure rod 36 on the second clamp plate 5 is vertically connected to the bottom of the holding slot 37; or, the pressure rod 36 on the second clamp plate 5 is vertically connected to the movable pressure block 32 and the pressure rod 36 on the first clamp plate 4 is vertically connected to the bottom of the holding slot 37.

That is, the pressure rods 36 of the two clamp plates are kept in the same orientation when connected to different pressure blocks, so that both pressure rods 36 on the left and right sides are kept upright. An opening of each hydraulic damper is formed in a side where the pressure rod 36 is located. That is to say that the hydraulic dampers in this application have upwards facing openings, and are compressed vertically, thereby effectively preventing hydraulic leakage and improving the damping effect and service life of the dampers 33.

Figure 8:
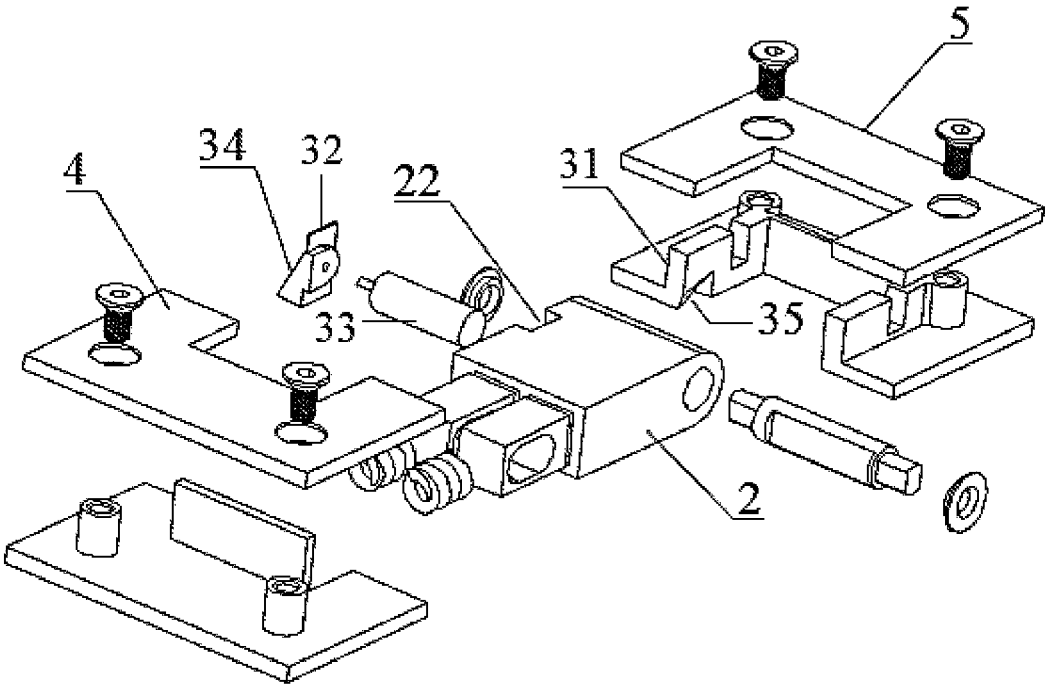
FIG. 8 is a disassembled view of the damping hinge in another embodiment of the invention.

Referring to FIG. 8, Embodiment 4 of the invention is as follows:

The damped hinge in this embodiment is suitable for connecting two portions of a machine, a vehicle, a door, a window, or other articles, and is also suitable for rotation of glass doors.

Based on Embodiment 1, in this embodiment, the damping mechanism 3 and the damper base 2 corresponding to the damping mechanism 3 are arranged in the first clamp plate 4 or the second clamp plate 5 of the damping hinge. That is, only one damping mechanism 3 is installed.

The damping mechanism 3 and the damper base 2 corresponding to the damping mechanism 3 installed on the first clamp plate 4 now serves as an example for explanation purposes. In this case, the first inclined surface 34 is only arranged on the movable pressure block 32 of the damping mechanism 3 and the second inclined surface 35 extends on extension or extending portion 35' in a fixed manner corresponding to the position of the first inclined surface 34 on the second clamp plate 5 so as to match with the first inclined surface 34. In other embodiments, the first inclined surface 34 is only arranged on the fixed pressure block 31 of the damping mechanism 3 and the position of the second inclined surface 35 on the second clamp plate 5 is changed relative to it.

On this basis, in this embodiment, the fixed pressure block 31 has a limit portion (not shown in the diagram) that is matched with the hydraulic damper and installed in a fixed position in the damper base 2. The damper groove 21 is formed with a slide notch 22 so as to always clamp both sides of the movable pressure block 32. This means that the movable pressure block 32 will always move in a vertical direction.

Figure 7:
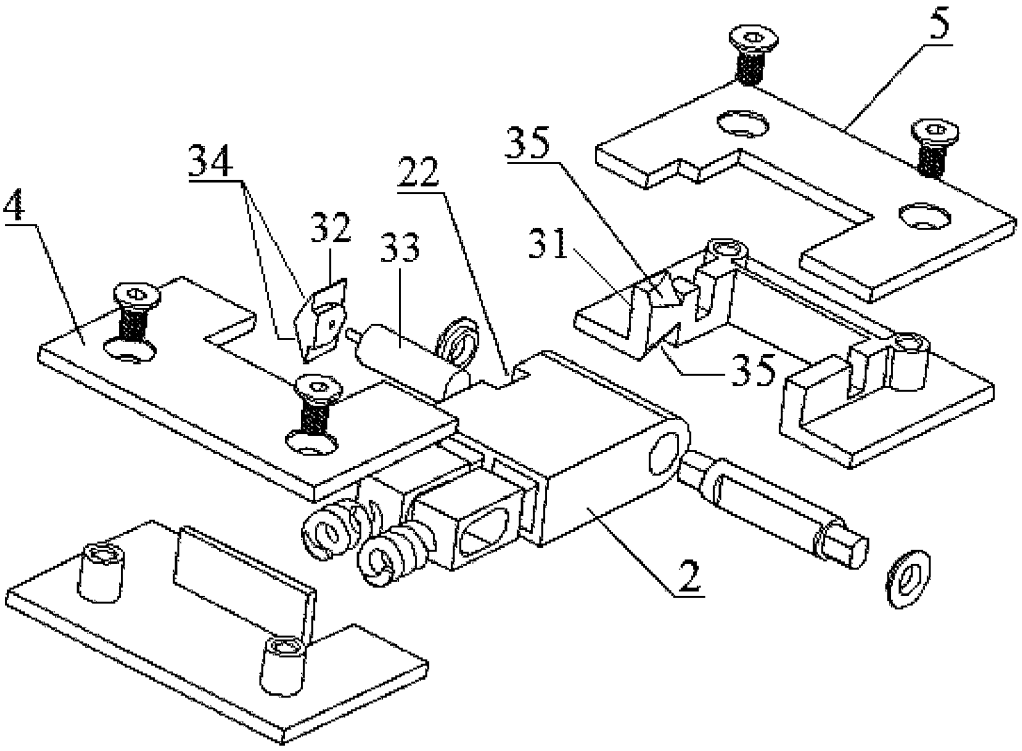
FIG. 7 is a disassembled view of the damping hinge in another embodiment of the invention.

Referring to FIG. 7, Embodiment 5 of the invention is as follows:

The damping hinge in this embodiment is suitable for connecting two portions of a machine, a vehicle, a door, a window, or other implements, and is also suitable for the rotation of glass shower doors.

Based on Embodiment 4, the movable pressure block 32 of the damping hinge includes two symmetrical first inclined surfaces 34. An extending portion of the second clamp plate 5 is fitted with two second inclined surfaces 35 that cooperatively connect with each of the first inclined surfaces 34.

Referring to FIG. 1 to FIG. 6, Embodiment 6 of the invention is as follows:

Based on Embodiment 1, as shown in FIG. 5 and FIG. 6, the damper base 2 and the damping mechanism 3 of the damping hinge are detachably connected to each other.

In the embodiment shown in FIG. 2, the damper base 2 and the damping mechanism 3 on the first clamp plate 4 as well as the damper base 2 and the damping mechanism 3 on the second clamp plate 5 are shown in FIG. 5. In the embodiment shown in FIG. 3 and FIG. 4, the damper base 2 and the damping mechanism 3 on the first clamp plate 4 are shown in FIG. 6. The damper base 2 and the damping mechanism 3 on the second clamp plate 5 are shown in FIG. 5.

Therein, FIG. 5 shows cooperative clamping of T-shaped stop blocks 13 and T-shaped slots 23. FIG. 6 shows the staggered clamping of square stop blocks 13' and L-shaped grooves 23'. It can be seen that the detachable mechanism of the damper base 2 and the damping mechanism 3 in this application is not limited to the structures shown in the drawings. All technical solutions making the damper base 2 and the damping mechanism 3 detachable should be regarded as equivalent embodiments in this application.

In addition, as shown in FIG. 2, the damping hinge in this embodiment further includes a rotation shaft 6 which connects the first clamp plate 4 to the second clamp plate 5. The rotation shaft 6 comprises a rotation pin 61, an automatic tension adjuster 62, and a torsional spring 63, wherein the automatic tension adjuster 62 is connected to the rotation pin 61 through the torsional spring 63 and is formed with an adjustment slot 64 that is externally accessible.

In this embodiment, as shown in FIG. 2, the automatic tension adjuster 62 is composed of chamfered adjustment blocks 65, a spring 66, a rotation block 67, and a pawl base 68, wherein the rotation block 67 is connected to the pawl base 68 and has two sides formed with holes. The spring 66 is arranged in the holes and is in abutting connection with the chamfered adjustment blocks 65; the chamfered adjustment blocks 65 are connected to the pawl base 68 and the adjustment slot 64 is formed in the pawl base 68. The adjustment slot 64 in this application is a hexagonal socket and can rotate by means of an Allen key to make sure that the chamfered adjustment blocks 65 are always in contact with the pawl base 68 to rotate the torsional spring 63. The closing strength of the hinge can be modified by adjusting the tension of the torsional spring 63, so that the closing strength of the hinge can be modified without disassembling the spring 66 adjuster. On this basis, users can adjust the closing strength of the hinge according to the most appropriate level suited to the application, thereby improving overall effect and service life of the damping hinge.

In addition, there is no limitation on the specific structure of the automatic tension adjuster 62. All embodiments referring to adjustment devices that are externally accessible should be regarded as equivalent embodiments in this the application.

In summary, the damping hinge proposed in this invention has the first inclined surface of each movable pressure block in abutting connection with the second inclined surface on the other clamp plate, so that the movable pressure block and the fixed pressure block can move vertically. Spiral inclined surfaces are adopted to ensure that each first inclined surface and the second inclined surface are in surface contact all the times when they press against each other, so that a better compression effect is achieved and damage to both inclined surfaces is prevented. The dampers are limited by the holding slots in the fixed pressure blocks and are guided by the slide grooves to compress and extend vertically. When the pressure rods of the two clamp plate assemblies are connected to different pressure blocks, the hydraulic dampers in this application have upward facing openings and are compressed vertically, thereby effectively preventing hydraulic fluid leakage. The adjustment slot that is externally accessible allows the user convenient access, so that the closing strength of the hinge can be adjusted without disassembling the tension adjuster. This significantly improves the damping effect and service life of the dampers. At the same time, the length of the damper grooves is arranged to be shorter than that of the damping mechanisms when the dampers are not compressed in order to secure the damping mechanisms. The holding slots are configured to fix the hydraulic dampers in place. Detachable connections make for convenient disassembly, which guarantees the safety, stability, and user experience of the damping mechanisms.

The above discusses only the embodiments of this invention and does not limit the patent scope of the invention. All equivalent transformations obtained on the basis of the contents in the explanation and attached diagrams of the invention, or direct or indirect applications to related technical fields, should fall within the patent protection scope of the invention.

It will be appreciated that the term "vertical" as used herein and variations thereof, such as "vertically", will be understood as references to orientations that are generally vertical as opposed to being mathematically precise orientations. Further, it will be appreciated that the term "vertical" and its variants as used herein refer to an in-use orientation of the hinge axis when the hinge is installed on a door or gate. Thus, that term as used herein is to be understood and interpreted with respect to such an in-use orientation of the hinge. In this context, therefore, it will be understood that the damper, which is arranged vertically in the damping mechanism, is arranged to extend substantially parallel to the hinge axis.

What is claimed is:

1. A damping hinge for controlled closing of a door, comprising:

a first clamp plate and a second clamp plate, wherein the first clamp plate and the second clamp plate are connected to one another for relative rotation about a hinge axis under bias of a spring, wherein one of the first clamp plate and the second clamp plate is to be mounted to the door and the other of the first clamp plate and the second clamp plate is to be mounted to a supporting structure, at least one damping mechanism arranged in the first clamp plate and/or in the second clamp plate, the damping mechanism including a damper arranged parallel to the hinge axis, with one end of the damper connected to a fixed pressure block and an opposite end of the damper connected to a movable pressure block that is moveable in a direction parallel to the hinge axis to transmit force to the damper, wherein the movable pressure block of the damping mechanism on said first or second clamp plate has a first inclined surface in abutting connection with a second inclined surface provided on the other clamp plate, whereby, during closing of the door, the second inclined surface drives the first inclined surface of the movable pressure block in the direction parallel to the hinge axis to transmit a force to the damper.

2. The damping hinge according to claim 1, wherein the first inclined surface and the second inclined surface are helical inclined surfaces in contact with each other; a helical angle of the helical inclined surfaces being in range of 5° to 85°.

3. The damping hinge according to claim 1, wherein a total length of the first inclined surface and the second inclined surface is less than a maximum rotation distance between the first clamp plate and the second clamp plate.

4. The damping hinge according to claim 1, wherein the damper is a hydraulic damper that includes an upright pressure rod, and wherein the spring is a torsion spring arranged along the hinge axis.

5. The damping hinge according to claim 4, comprising a damper base for housing the damping mechanism in the respective first or second clamp plate, wherein a damper groove is formed on the damper base, and wherein the damping mechanism is arranged in the damper groove.

6. The damping hinge according to claim 5, wherein a holding slot or cavity for the hydraulic damper is formed in the fixed pressure block, wherein a slide groove is formed on a side of the fixed pressure block, close to the movable pressure block, and a slide rod extends from the movable pressure block for sliding engagement with the slide groove.

7. The damping hinge according to claim 6, wherein the at least one damping mechanism comprises a damping mechanism arranged in each of the first clamp plate and the second clamp plate;

wherein the pressure rod of the damper within the first clamp plate is vertically connected to the movable pressure block;

wherein the pressure rod of the damper within the second clamp plate is vertically connected to a base of the holding slot or cavity in the fixed pressure block; and wherein the first inclined surface of the movable pressure block of the first clamp plate is in abutting connection with the second inclined surface provided on an extension of the fixed pressure block of the second clamp plate.

8. The damping hinge according to claim 5, wherein the damping mechanism is arranged in the first clamp plate; and wherein the second inclined surface is arranged on an extending portion of the second clamp plate assembly, close to the first inclined surface.

9. The damping hinge according to claim 8, wherein the movable pressure block includes two symmetrical first inclined surfaces, an extending portion of the second clamp plate is equipped with two second inclined surfaces that match and connect with the respective first inclined surfaces.

10. The damping hinge according to claim 5, wherein the damping mechanism is detachably connected to the damper base.

11. The damping hinge according to claim 1, wherein the first clamp plate or the second clamp plate is adapted to be mounted in a glass door.

12. The damping hinge according to claim 11, wherein the first clamp plate or the second clamp plate includes a damper base for housing the damping mechanism and the damper base is adapted to be mounted in an edge recess formed in the glass door.

13. The damping hinge according to claim 1, wherein the second inclined surface is provided on an extension from the other clamp plate that extends towards the first inclined surface.

14. A damping hinge for controlled closing of a door, comprising:

a first clamp plate and a second clamp plate, wherein the first clamp plate and the second clamp plate are connected to one another for relative rotation about a hinge axis under bias of a torsion spring arranged on the hinge axis, wherein one of the first clamp plate and the second clamp plate is to be mounted to the door and the other of the first clamp plate and the second clamp plate is to be mounted to a supporting structure, a damping mechanism arranged in the first clamp plate or the second clamp plate, the damping mechanism including a damper arranged substantially parallel to the hinge axis, with one end of the damper connected to a fixed pressure block and an opposite end of the damper connected to a movable pressure block that is constrained to move only in a direction parallel to the hinge axis for transmitting force to the damper, wherein the movable pressure block of the damping mechanism on said first or second clamp plate has a first inclined surface configured for abutting connection with a second inclined surface provided on an extension from the other clamp plate, wherein the abutting connection between the first and second inclined surfaces during closing of the door operates to move the movable pressure block in the direction parallel to the hinge axis to transmit force to the damper.

15. The damping hinge according to claim 14, wherein a damping mechanism is arranged on both the first clamp plate and the second clamp plate, each damping mechanism including a damper which is arranged substantially parallel to the hinge axis, wherein one end of the damper on the first clamp plate is operatively connected to a fixed pressure block and an opposite end of the damper on the first clamp plate is operatively connected to a movable pressure block that is constrained to move only in a direction parallel to the hinge axis, and wherein one end of the damper on the second clamp plate is operatively connected to a fixed pressure block and an opposite end of the damper on the second clamp plate is operatively connected to a movable pressure block that is constrained to move only in a direction parallel to the hinge axis.

16. The damping hinge according to claim 15, wherein a first surface of the movable pressure block of the damping mechanism on the first clamp plate is adapted for abutting connection with a second surface provided on an extension from the second clamp plate; and wherein a first surface of the movable pressure block of the damping mechanism on the second clamp plate is adapted for abutting connection with a second surface provided on an extension from the first clamp plate.

17. The damping hinge according to claim 16, wherein the extension from the second clamp plate extends from the fixed pressure block of the damping mechanism on the second clamp plate, and/or wherein the extension from the first clamp plate extends from the fixed pressure block of the damping mechanism on the first clamp plate.

18. The damping hinge according to claim 14, wherein the first inclined surface and the second inclined surface are helical inclined surfaces in contact with each other; a helical angle of the helical inclined surfaces being in a range of 5° to 85°.

19. The damping hinge according to claim 14, wherein the damper is a hydraulic damper that includes an upright pressure rod.

20. The damping hinge according to claim 14, wherein the first clamp plate or the second clamp plate includes a damper base for housing the damping mechanism and wherein the damper base is adapted to be mounted in an edge recess formed in a glass door.

* * * * *